US011364725B2

(12) United States Patent
Moon et al.

(10) Patent No.: US 11,364,725 B2
(45) Date of Patent: Jun. 21, 2022

(54) AUTHENTICATION MECHANISMS

(71) Applicant: HEWLETT-PACKARD DEVELOPMENT COMPANY, L.P., Spring, TX (US)

(72) Inventors: Jiwon Moon, Pangyo (KR); Minul Lee, Pangyo (KR); Woongyong Choi, Suwon (KR); SeungSup Lee, Suwon (KR); Jinhwa Hong, Suwon (KR); Matthew James Storey, Austin, TX (US); An Tran, Austin, TX (US); Bennett Alexander Nadeau, Austin, TX (US); Zackary Thomas Hickman, Austin, TX (US)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 71 days.

(21) Appl. No.: 17/050,146

(22) PCT Filed: Aug. 30, 2018

(86) PCT No.: PCT/US2018/048796
§ 371 (c)(1),
(2) Date: Oct. 23, 2020

(87) PCT Pub. No.: WO2020/046328
PCT Pub. Date: Mar. 5, 2020

(65) Prior Publication Data
US 2021/0094304 A1 Apr. 1, 2021

(51) Int. Cl.
*B41J 2/175* (2006.01)

(52) U.S. Cl.
CPC ..... *B41J 2/17546* (2013.01); *B41J 2/1752* (2013.01)

(58) Field of Classification Search
CPC .... B41J 2/175; B41J 2/17503; B41J 2/17506; B41J 2/17509; B41J 2/1752;
(Continued)

(56) References Cited

U.S. PATENT DOCUMENTS 2,641,743 A 9/1953 Bonanno
6,012,795 A 1/2000 Saito et al.
(Continued)

FOREIGN PATENT DOCUMENTS

CN 101163594 A 4/2008
EP 1671568 B1 6/2006
(Continued)

*Primary Examiner* — Anh T Vo
(74) *Attorney, Agent, or Firm* — Staas & Halsey LLP

(57) ABSTRACT

In some examples, an apparatus can include a mating interface coupled to a dispense interface to interact with a print particle dispense nozzle, a locking mechanism coupled to the dispense interface to prevent the print particle dispense nozzle from depositing a print particle to the dispense interface, and an authentication mechanism coupled to the locking mechanism to: authenticate the print particle dispense nozzle, and unlock the locking mechanism when the print particle dispense nozzle is authenticated to allow the print particle dispense nozzle to deposit the print particle to the dispense interface.

15 Claims, 6 Drawing Sheets

(58) Field of Classification Search
CPC ..... B41J 2/17523; B41J 2/17546; B41J 2/17553; G03G 15/0879; G03G 15/0886; G03G 15/224; G03G 21/1892; G03G 2221/1654
See application file for complete search history.

(56) References Cited

U.S. PATENT DOCUMENTS

| | | | | |
|---|---|---|---|---|
| 6,350,014 | B1 | 2/2002 | Carlton et al. | |
| 6,853,814 | B2 | 2/2005 | Ito et al. | |
| 7,075,684 | B2 | 7/2006 | Silverbrook | |
| 7,344,232 | B2 | 3/2008 | Silverbrook | |
| 7,486,910 | B2 | 2/2009 | Kitozaki | |
| 8,190,070 | B2 | 5/2012 | Maeshima et al. | |
| 8,396,379 | B2 | 3/2013 | Tsukijima | |
| 8,588,659 | B2 | 11/2013 | Carter et al. | |
| 9,098,055 | B2 | 8/2015 | Maul | |
| 9,475,298 | B2 * | 10/2016 | Osakabe | B41J 2/175 |
| 10,894,419 | B2 * | 1/2021 | Bartel | B41J 2/17523 |
| 2005/0151764 | A1 | 7/2005 | Grady et al. | |
| 2009/0096836 | A1 | 4/2009 | Haines et al. | |
| 2013/0250355 | A1 | 9/2013 | Takamiya | |
| 2014/0263423 | A1 | 9/2014 | Akdogan et al. | |
| 2017/0305164 | A1 * | 10/2017 | Orihara | B41J 2/17553 |
| 2017/0326882 | A1 | 11/2017 | Okude et al. | |
| 2018/0001650 | A1 * | 1/2018 | Miyashita | B41J 2/17506 |

FOREIGN PATENT DOCUMENTS

| | | |
|---|---|---|
| EP | 2642743 A2 | 9/2013 |
| EP | 2641743 | 12/2014 |
| RU | 2660387 | 7/2018 |

* cited by examiner

AUTHENTICATION MECHANISMS

CROSS REFERENCE TO RELATED APPLICATIONS

This application is a U.S. National Stage Application which claims the benefit under 35 U.S.C. § 371 of International Patent Application No. PCT/US2018/048796 filed on Aug. 30, 2018, the contents of which are incorporated herein by reference.

BACKGROUND

Imaging systems, such as printers, copiers, etc., may be used to form markings on a physical medium, such as text, images, etc. In some examples, imaging systems may form markings on the physical medium by performing a print job. A print job can include forming markings such as text and/or images by transferring a print substance (e.g., ink, toner, etc.) to the physical medium.

DETAILED DESCRIPTION

Figure 1:
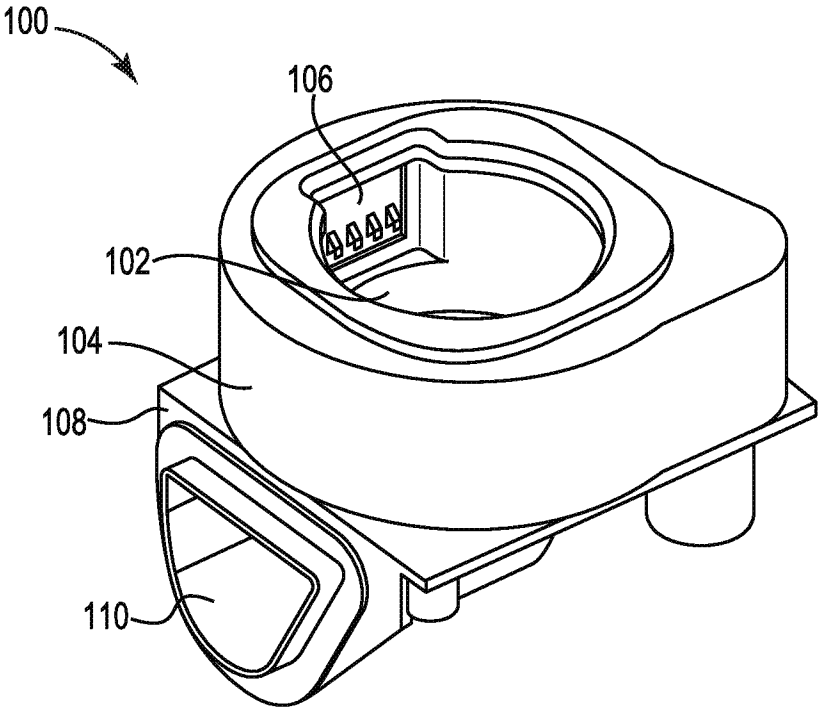
FIG. 1 illustrates a view of an example of a print substance apparatus consistent with the disclosure.

Imaging devices may include a supply of a print material particles located in a reservoir. As used herein, the term "print material particles" refers to a substance which, when applied to a medium, can form representation(s) on the medium during a print job. In some examples, the print material particles can be deposited in successive layers to create three-dimensional (3D) objects. For example, print material particles can include a powdered semi-crystalline thermoplastic material, a powdered metal material, a powdered plastic material, a powdered composite material, a powdered ceramic material, a powdered glass material, a powdered resin material, and/or a powdered polymer material, among other types of powdered or particulate material. The print material particles can be particles with an average diameter of less than one hundred microns. For example, the print material particles can be particles with an average diameter of between 0-100 microns. However, examples of the disclosure are not so limited. For example, print material particles can be particles with an average diameter of between 20-50 microns, 5-10 microns, or any other range between 0-100 microns. The print material particles can be fused when deposited to create 3D objects.

The print material particles can be deposited onto a physical medium. As used herein, the term "imaging device" refers to any hardware device with functionalities to physically produce representation(s) on the medium. In some examples, the imaging device can be a 3D printer. For example, the 3D printer can create a representation (e.g., a 3D object) by depositing print material particles in successive layers to create the 3D object.

The reservoir including the print material particles may be inside of the imaging device and include a supply of the print material particles such that the imaging device may draw the print material particles from the reservoir as the imaging device creates the images on the print medium. As used herein, the term "reservoir" refers to a container, a tank, and/or a similar vessel to store a supply of the print material particles for use by the imaging device.

As the imaging device draws the print material particles from the reservoir, the amount of print material particles in the reservoir may deplete. As a result, the amount of print material particles in the reservoir of the imaging device may have to be replenished.

A print material particles supply may be utilized to fill and/or refill the reservoir of the imaging device with print material particles. During a fill and/or refill operation, the print material particles supply can transfer print material particles from the print material particles supply to the reservoir of the imaging device.

The present disclosure relates to a print substance apparatus that includes a flexible cable to authenticate a print particle dispense nozzle. As used herein, a print particle dispense nozzle can be a device to fill/refill the reservoir of the imaging device. In some examples, the print substance apparatus can authenticate the manufacturer of the print particle dispense nozzle and/or authenticate a type of print material particles within the print particle dispense nozzle prior to allowing the print particle dispense nozzle to provide the print material particles into the reservoir of the imaging device.

FIG. 1 illustrates a view of an example of a print substance apparatus 100 consistent with the disclosure. In some examples, the print substance apparatus 100 can include a rotatable mating interface 102 that includes an electrical contact 106, a circuit assembly coupled to a dispense interface 108 that is coupled to the rotatable mating interface 102, and a flexible cable coupled to the electrical contact 106 of the rotatable mating interface 102 and the circuit assembly of the dispense interface 108. In some examples, the flexible cable can communicatively couple the electrical contact 106 and the circuit assembly. As used herein, communicatively coupling can include allowing communication signals to be transferred from a first location to a second location.

In some examples, the print substance apparatus 100 can include a mating interface 102 coupled to a dispense interface 108 to interact with a print particle dispense nozzle. In some examples, the print substance apparatus 100 can include a locking mechanism coupled to the dispense interface 108 to prevent the print particle dispense nozzle from depositing a print particle to the dispense interface 108. In some examples, the print substance apparatus 100 can include an authentication mechanism coupled to the locking mechanism to authenticate the print particle dispense nozzle and unlock the locking mechanism when the print particle dispense nozzle is authenticated to allow the print particle dispense nozzle to deposit the print particle to the dispense interface 108. As used herein, an authentication mechanism can include a circuit assembly that is communicatively coupled to a locking mechanism to alter a state of the locking mechanism. For example, the authentication mechanism can be a circuit assembly coupled to the dispense interface 108 to lock and unlock the mating interface 102 via the locking mechanism.

In some examples, the print substance apparatus 100 can be utilized to receive a print particle dispense nozzle within the rotatable mating interface 102. For example, the print particle dispense nozzle can be inserted into an aperture of the rotatable mating interface 102. In some examples, the rotatable mating interface 102 can include a circuit assembly that includes the electrical contact 106. In some examples, the electrical contact 106 can correspond to electrical contacts of a print particle dispense nozzle. In some examples, information relating to the print particle dispense nozzle and/or contents of the print particle dispense nozzle can be transferred through the electrical contact 106. In some examples, the electrical contact 106 can be an electrical interface coupled to the mating interface 102 to receive a signal from the print particle dispense nozzle when the print particle dispense nozzle is inserted into the mating interface 102. As described herein, the signal can be received by the authentication mechanism to authenticate the print particle dispense nozzle.

In some examples, the print substance apparatus 100 can be utilized to authenticate the print particle dispense nozzle based on the information transferred through the electrical contact 106. For example, the print substance apparatus 100 can utilize the information to authenticate that the print particle dispense nozzle is from a particular manufacturer. In another example, the print substance apparatus 100 can utilize the information to authenticate that the print particle dispense nozzle contains a particular type of print material particles. In this example, the print substance apparatus 100 can be utilized to transfer the print material particles from the print particle dispense nozzle into a print material particle reservoir of an imaging device.

In some examples, each type of print material particles can include a separate print material particle reservoir within the imaging device. In some examples, the print substance apparatus 100 can identify the type of print material particles within the print particle dispense nozzle and determine if the print material particles within the print particle dispense nozzle are compatible with a print material particle reservoir that is coupled to the print substance apparatus 100. In these examples, the print particle dispense nozzle can be authenticated when the type of print material particles within the print particle dispense nozzle match a type of print material particles within the print material particle reservoir coupled to the print substance apparatus 100.

In some examples, the print substance apparatus 100 can include a dispense interface 108 that is coupled to the rotatable mating interface 102. In some examples, the rotatable mating interface 102 can rotate with respect to the dispense interface 108. In some examples, the dispense interface 108 can be stationary while the rotatable mating interface 102 is rotatable in a first direction (e.g., clockwise, etc.) and/or a second direction (e.g., counterclockwise, etc.). In some examples, the dispense interface 108 can include a port 110 that can be coupled to a print material particle reservoir of the imaging device. In some examples, the mating interface 102 can include a first aperture to allow print material particles to be received by the dispense interface 108 and the dispense interface 108 includes a second aperture or port 110 to provide the print material particles to a print material supply or print material reservoir of the imaging device. For example, the first aperture of the mating interface 102 and the second aperture or port 110 of the dispense interface 108 can be aligned when the mating interface 102 is in the second position or unlocked position to allow a print particle to pass through the first aperture and the second aperture.

In some examples, the rotatable mating interface 102 can include a port that can provide the print material particles to the port 110 of the dispense interface 108 in an open position and prevent the print material particles from entering the port 110 in a closed position. In some examples, the rotatable mating interface 102 can rotate to alter between the closed position and the open position. In some examples, the rotatable mating interface 102 can be locked in a first position (e.g., closed position) until the print particle dispense nozzle is authenticated. When the print particle dispense nozzle is authenticated, the rotatable mating interface 102 can be rotated from the first position to a second position (e.g., open position).

In some examples, rotatable mating interface 102 can be locked in the second position (e.g., open position) until a signal is received by the print particle dispense nozzle. In some examples, the signal can indicate that the print particle dispense nozzle is empty or has delivered a particle quantity of print material particles to the print substance apparatus 100. In some examples, the signal can unlock the rotatable mating interface 102 and allow the rotatable mating interface 102 to be rotated to the first position (e.g., closed position) such that the print particle dispense nozzle can be removed from the rotatable mating interface 102.

In some examples, the print substance apparatus 100 can include a cover 104. In some examples, the cover 104 can be utilized to protect the rotatable mating interface 102 and/or components of the print substance apparatus 100 from being damaged. In some examples, the cover 104 can include an aperture with a particular shape to prevent particular types of print particle dispense nozzles from being inserted into the rotatable mating interface 102. In this way, the cover 104 can prevent unauthorized print particle dispense nozzles from being inserted into the rotatable mating interface 102.

The print substance apparatus 100 can be utilized to authenticate print particle dispense nozzles. As described herein, authenticating the print particle dispense nozzles can prevent unwanted print particle dispense nozzles from dispensing print material particles into the print material particle reservoir of the imaging device.

Figure 2:
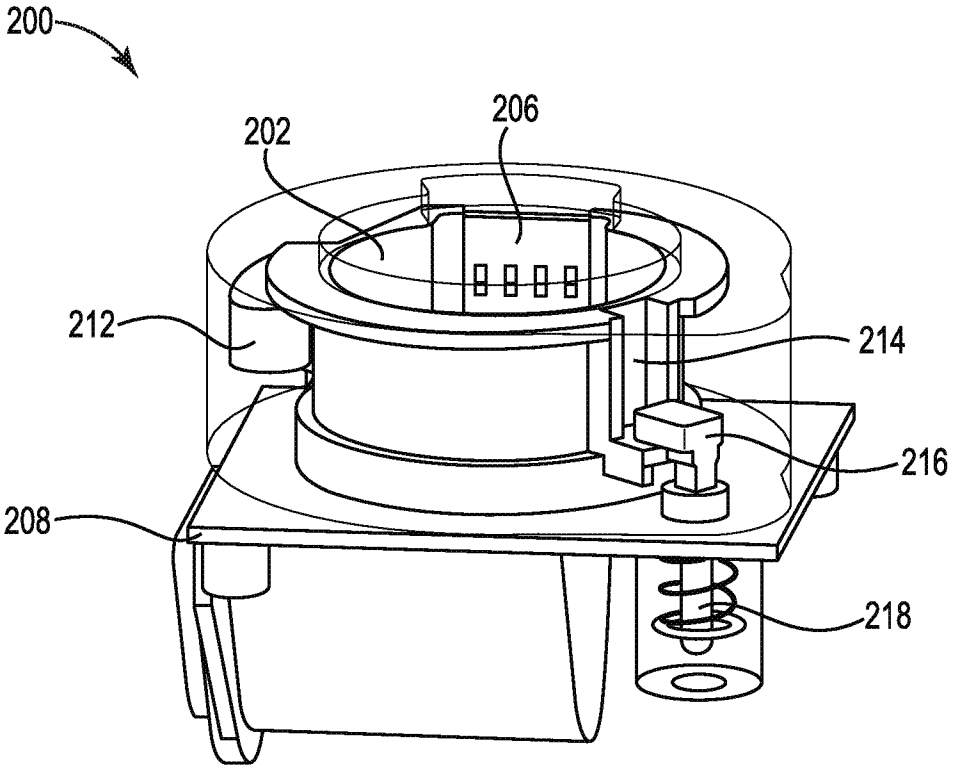
FIG. 2 illustrates a view of an example of a print substance apparatus consistent with the disclosure.

FIG. 2 illustrates a view of an example of a print substance apparatus 200 consistent with the disclosure. In some examples, the print substance apparatus 200 can include the same or similar components as the print substance apparatus 100 as illustrated in FIG. 1. For example, the print substance apparatus 200 can include a dispense interface 208 coupled to a print particle reservoir. In some examples, the dispense interface 208 can include a circuit assembly. In some example, the print substance apparatus can include a mating interface 202 coupled to the dispense interface 208 to interact with a print particle dispense nozzle.

In some examples, the mating interface 202 can include an electrical contact 206 that interacts with a corresponding electrical contact of the print particle dispense nozzle and a flexible cable 212 coupled to the electrical contact 206 of the mating interface 202. In some examples, the circuit assembly of the dispense interface can be utilized to communicatively couple the print particle dispense nozzle with the circuit assembly when the print particle dispense nozzle interacts with the mating interface 202.

In some examples, the print substance apparatus 200 can include a locking mechanism 216 that can interact with a locking portion 214 or locking tab of the mating interface 202. In some examples, the locking portion 214 or locking tab can be positioned at an exterior portion of the mating interface 202. As described herein, the locking mechanism 216 can prevent the mating interface 202 from rotating when the locking mechanism 216 is in a locked position. As described herein, the locking mechanism 216 can be unlocked when the print particle dispense nozzle is authenticated. For example, the locking mechanism 216 can lock the mating interface 202 in a closed position until the print particle dispense nozzle is authenticated through the electrical contact 206 and/or the flexible cable 212.

In some examples, the locking mechanism 216 can be coupled to an actuator 218. In some examples, the actuator 216 can be a spring actuator that can move the locking mechanism from a first location (e.g., locked location) to a second location (e.g., unlocked location. In some examples, the locking mechanism and the actuator 218 can be coupled to the dispense interface 208.

The print substance apparatus 200 can be utilized to authenticate print particle dispense nozzles. As described herein, authenticating the print particle dispense nozzles can prevent unwanted print particle dispense nozzles from dispensing print material particles into the print material particle reservoir of the imaging device.

Figure 3:
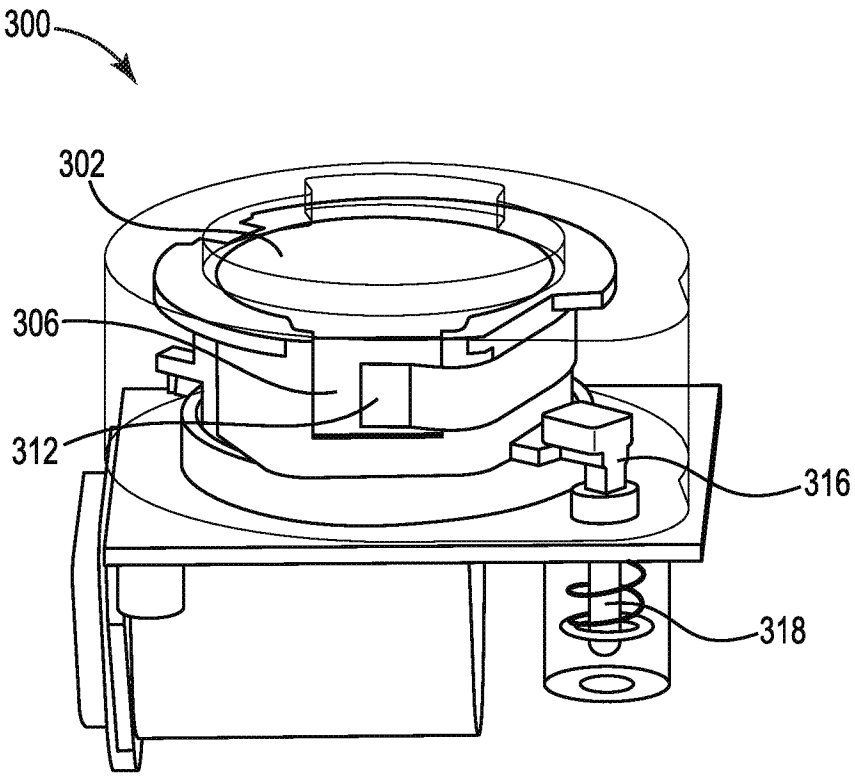
FIG. 3 illustrates a view of an example of a print substance apparatus consistent with the disclosure.

FIG. 3 illustrates a view of an example of a print substance apparatus 300 consistent with the disclosure. In some examples, the print substance apparatus 300 can include the same or similar components as the print substance apparatus 100 as illustrated in FIG. 1 and/or the print substance apparatus 200 as referenced in FIG. 2. For example, the print substance apparatus 300 can include a dispense interface 308 coupled to a print particle reservoir. In some examples, the dispense interface 308 can include a circuit assembly. In some example, the print substance apparatus 300 can include a mating interface 302 coupled to the dispense interface 308 to interact with a print particle dispense nozzle.

In some examples, the mating interface 302 can include an electrical contact 306 that interacts with a corresponding electrical contact of the print particle dispense nozzle and a flexible cable 312 coupled to the electrical contact 306 of the mating interface 302. In some examples, the circuit assembly of the dispense interface can be utilized to communicatively couple the print particle dispense nozzle with the circuit assembly when the print particle dispense nozzle interacts with the mating interface 302.

In some examples, the print substance apparatus 300 can include a locking mechanism 316 that can interact with a locking portion 314 of the mating interface 302. As described herein, the locking mechanism 316 can prevent the mating interface 302 from rotating when the locking mechanism 316 is in a locked position. As described herein, the locking mechanism 316 can be unlocked when the print particle dispense nozzle is authenticated. For example, the locking mechanism 316 can lock the mating interface 302 in a closed position until the print particle dispense nozzle is authenticated through the electrical contact 306 and/or the flexible cable 312. In some examples, the flexible cable 312 can provide a continuous communicative coupling between the electrical contact 306 and the circuit assembly as the rotatable mating interface 302 is rotated from a first position (e.g., locked position) to a second position (e.g., open position).

In some examples, the locking mechanism 316 can be coupled to an actuator 318. In some examples, the actuator 316 can be a spring actuator that can move the locking mechanism from a first location (e.g., locked location) to a second location (e.g., unlocked location. In some examples, the locking mechanism and the actuator 318 can be coupled to the dispense interface 308.

In some examples, the print substance apparatus 300 can include a mating interface 302 coupled to a dispense interface 308 to interact with a print particle dispense nozzle. In some examples, the print substance apparatus 300 can include an electrical interface 306 positioned at an interior portion of the mating interface 302 to interact with a corresponding electrical interface of the print particle dispense nozzle when the print particle dispense nozzle is positioned within the mating interface 302. In some examples, the print substance apparatus 300 can include a locking mechanism 316 coupled to the dispense interface 308 to interact with a locking tab (e.g., locking portion 214 as illustrated in FIG. 2, etc.) of the mating interface 302.

In some examples, the print substance apparatus 300 can include an authentication mechanism or circuit assembly coupled to the locking mechanism 316 to receive a first signal from the print particle dispense nozzle to authenticate the print particle dispense nozzle and unlock the locking mechanism 316 to allow the mating interface 302 to rotate from a first position to a second position. In some examples, the authentication mechanism can receive a second signal from the print particle dispense nozzle to confirm the print particle dispense nozzle is empty and unlock the locking mechanism 316 to allow the mating interface 302 to rotate from the second position to the first position.

In some examples, the authentication mechanism can lock the locking mechanism 316 when the mating interface 302 is at the second position to prevent the print particle dispense nozzle from being removed from the mating interface 302 at the second position.

The print substance apparatus 300 can be utilized to authenticate print particle dispense nozzles. As described herein, authenticating the print particle dispense nozzles can prevent unwanted print particle dispense nozzles from dispensing print material particles into the print material particle reservoir of the imaging device.

Figure 4:
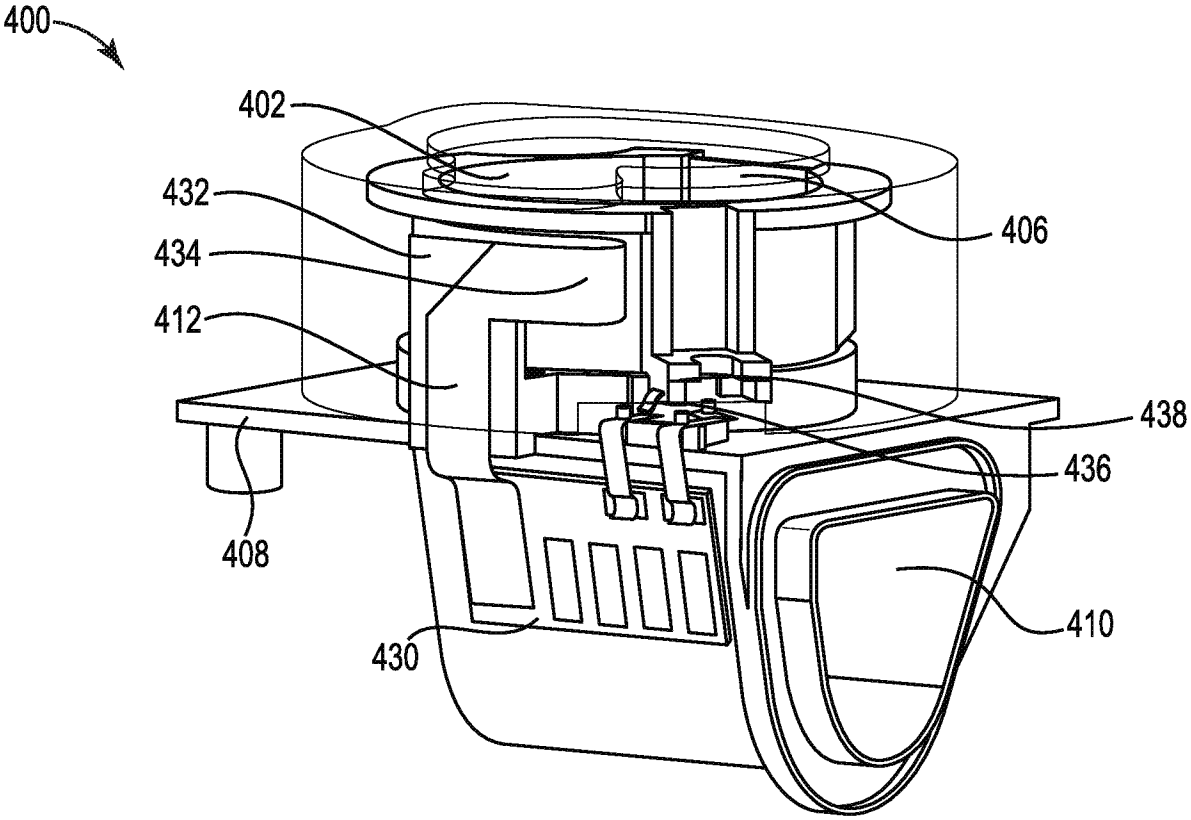
FIG. 4 illustrates a view of an example of a print substance apparatus consistent with the disclosure.

FIG. 4 illustrates a view of an example of a print substance apparatus 400 consistent with the disclosure. In some examples, the print substance apparatus 400 can include the same or similar components as the print substance apparatus 100 as illustrated in FIG. 1, the print substance apparatus 200 as referenced in FIG. 2, and/or the print substance apparatus 300 as referenced in FIG. 3. For example, the print substance apparatus 400 can include a rotatable mating interface 402 that includes an aperture to receive a print particle dispense nozzle. In this example, the print substance apparatus 400 can include a first circuit assembly 406 that includes an electrical contact positioned at an interior location of the aperture to interact with the print particle dispense nozzle when the print particle dispense nozzle is positioned within the aperture of the rotatable mating interface 402.

In some examples, the print substance apparatus 400 can include an electrical coupling positioned at an exterior location of the aperture. For example, a flexible cable 412 can be coupled to the first circuit assembly 406 at an exterior position. In some examples, the print substance apparatus 400 can include a dispense interface 408 coupled to the rotatable mating interface 402 that includes a second circuit assembly 430. In some examples, the print substance apparatus 400 can include a locking mechanism to interact with the rotatable mating interface 402 to allow the rotatable mating interface 402 to rotate when the print particle dispense nozzle is authenticated and prevents the rotatable mating interface 402 from rotating when the print particle dispense nozzle is not authenticated.

As described herein the print substance apparatus 400 can include a flexible cable 412 coupled to the electrical coupling of the rotatable mating interface 402 and the second circuit assembly 430 of the dispense interface 408 to communicatively couple the first circuit assembly 406 and the second circuit assembly 430. In some examples, the print particle dispense nozzle is authenticated or not authenticated based on communication through the flexible cable 412. In some examples, the flexible cable 412 can transmit an authentication signal from the electrical contact or first circuit assembly 406 to the second circuit assembly 430 at a first position of the rotatable mating interface 402 and at a second position of the rotatable mating interface 402.

In some examples, the flexible cable 412 can wrap around a portion of the exterior portion of the rotatable mating interface 402 when the rotatable mating interface 402 is rotated from a first position to a second position. In some examples, the flexible cable 412 is a ribbon cable that includes a plurality of individual communication channels. As used herein, a ribbon cable includes a multi-wire planar cable with a plurality of conductive wires running parallel to each other in a flat plane. In some examples, the flexible cable 412 can communicatively couple the first circuit assembly 406 and the second circuit assembly 430 during a rotation of the rotatable mating interface. In this way, the print particle dispense nozzle can be authenticated during the rotation to prevent an initial authorization followed by an unauthorized print particle dispense nozzle depositing the print material particles into the print substance apparatus 400.

As described herein, the print substance apparatus 400 can include a locking mechanism that can interact with a locking portion of the mating interface 402. As described herein, the locking mechanism can prevent the mating interface 402 from rotating when the locking mechanism is in a locked position. As described herein, the locking mechanism can be unlocked when the print particle dispense nozzle is authenticated. For example, the locking mechanism can lock the mating interface 402 in a closed position until the print particle dispense nozzle is authenticated through the first circuit assembly 406, through the flexible cable 412, to the second circuit assembly 430.

In some examples, the print substance apparatus 400 can include a contact 436 coupled to the second circuit assembly 430 that interacts with the mating interface 402 at a particular position. For example, the mating interface 402 can include a tab 438 that can interact with the contact 436. In this example, the second circuit assembly 430 can determine a position of the mating interface 402 when the tab 436 interacts with the contact 436. In some examples, the second circuit assembly 430 can determine that the mating interface 402 is in an open position when the tab 436 interacts with the contact 436. As described herein, a locking mechanism can be altered to a locked position when the tab 436 interacts with the contact 436 to lock the mating interface 402 in a locked position. In some examples, the contact 436 can be a spring contact that indicates a proximity of a tab 436 coupled to the mating interface 402. As used herein, a spring contact can include a spring loaded conductive contact that can be depressed to generate a signal.

In some examples, the mating interface 402 can remain in a locked position until a signal is received that the print particle dispense nozzle has deposited a particular quantity of print material particles. For example, the print particle dispense nozzle can provide a signal to the first circuit assembly 406. The signal can be transmitted through the flexible cable 412 to the second circuit assembly 430. In this example, the locking mechanism can unlock the mating interface 402 and allow the mating interface 402 to rotate to a first position or locked position. As described herein, the second circuit assembly 430 can be communicatively coupled to the locking mechanism to lock or unlock the locking mechanism based on the authentication of the print particle dispense nozzle.

In some examples, the print substance apparatus 400 can include a bracket 432 coupled to the dispense interface 408. In some examples, the bracket 432 can guide the flexible cable 412 from the second circuit assembly 430 to an exterior portion of the mating interface 402. In some examples, the flexible cable 412 can include an excess portion 434 that allows the flexible cable 412 to wrap around the exterior portion of the mating interface 402 when the mating interface 402 is rotated from a first position to a second position. In this way, the flexible cable 412 can provide continuous communication between the first circuit assembly 406 and the second circuit assembly 430 during rotation of the mating interface 402. Providing continuous communication between the first circuit assembly 406 and the second circuit assembly 430 can prevent unauthorized print particle dispense nozzles from depositing print particles into the print substance apparatus 400.

In some examples, the print substance apparatus 400 can include a dispense interface 408 that includes a port 410 that can be coupled to a print material particle reservoir of the imaging device. In some examples, the rotatable mating interface 402 can include a port that can provide the print material particles to the port 410 of the dispense interface 408 in an open position and prevent the print material particles from entering the port 410 in a closed position. In some examples, the rotatable mating interface 402 can rotate to alter between the closed position and the open position. In some examples, the rotatable mating interface 402 can be locked in a first position (e.g., closed position) until the print particle dispense nozzle is authenticated. When the print particle dispense nozzle is authenticated, the rotatable mating interface 402 can be rotated from the first position to a second position (e.g., open position).

In some examples, the print substance apparatus 400 can include a dispense interface 408 coupled to the print particle supply or print particle reservoir. The print substance apparatus 400 can also include a mating interface 402 coupled to the dispense interface 408 to interact with a print particle dispense nozzle. In some examples, the mating interface 402 is rotatable from a first position to a second position. In some examples, the print substance apparatus 400 can include a locking mechanism coupled to the dispense interface 408 to control the rotation of the mating interface 402. As described herein, an authentication mechanism (e.g., second circuit assembly 430) can be coupled to the locking mechanism to perform a number of functions.

In some examples, the second circuit assembly 430 can be utilized to receive a first signal from the print particle dispense nozzle when the mating interface 402 is in the first position. The second circuit assembly 430 can authenticate the print particle dispense nozzle based on the first signal. The second circuit assembly can then instruct the locking mechanism to allow the mating interface 402 to rotate from the first position to the second position when the print particle dispense nozzle is authenticated. In some examples, the first signal can be information or authentication information for the print particle dispense nozzle. For example, the first signal can include a manufacturer of the print particle dispense nozzle and a type of print particle within the print particle dispense nozzle. As described herein, the print particle dispense nozzle can be authenticated when the type of print particles within the print particle dispense nozzle match print particles to be dispensed by the print particle apparatus 400.

The second circuit assembly can also receive a second signal from the print particle dispense nozzle when the mating interface 402 is in the second position and instruct the locking mechanism to allow the mating interface 402 to rotate from the second position to the first position based on the second signal. In some examples, the second signal can include an indication that the print particle dispense nozzle includes a particular quantity of a print particle. In some examples, the second signal can be a signal that the print particle dispense nozzle is empty or that the print particle dispense nozzle has deposited a particular quantity of print particles to the print particle apparatus 400.

The print substance apparatus 400 can be utilized to authenticate print particle dispense nozzles. As described herein, authenticating the print particle dispense nozzles can prevent unwanted print particle dispense nozzles from dispensing print material particles into the print material particle reservoir of the imaging device.

Figure 5:
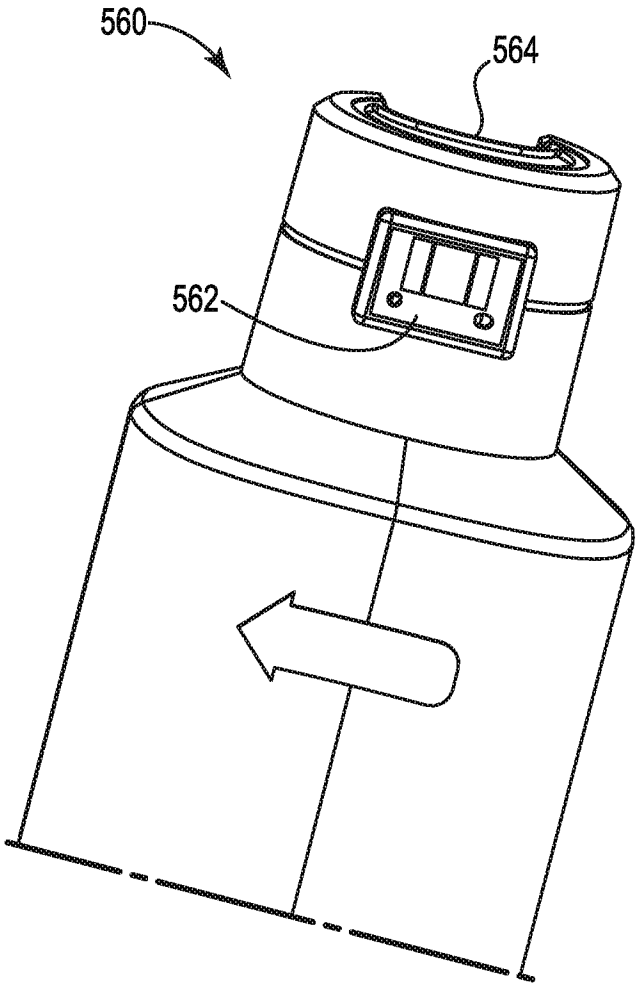
FIG. 5 illustrates a view of an example of a print particle dispense nozzle consistent with the disclosure.

FIG. 5 illustrates a view of an example of a print particle dispense nozzle 560 consistent with the disclosure. In some examples, the print particle dispense nozzle 560 can be a syringe that includes print material particles as described herein. In some examples, the print particle dispense nozzle 560 can include an output nozzle 564 that can be inserted into a mating interface as described herein. In some examples, the output nozzle 564 can be utilized to dispense the print material particles when the mating interface of a print substance apparatus is rotated from a closed position to an open position.

In some examples, the print particle dispense nozzle 560 can include a circuit assembly 562 that includes contacts that can interact with contacts of a print substance apparatus. For example, the circuit assembly 562 can be utilized to transmit signals to a circuit assembly coupled to a mating interface. Thus, when the output nozzle 564 is inserted into an aperture of the mating interface, contacts of the circuit assembly 562 can interact with contacts of the mating interface to provide information relating to the print particle dispense nozzle 560.

In some examples, the information transmitted to the mating interface can be authentication information. As used herein, the authentication information can include information to authenticate the print particle dispense nozzle 560. For example, the authentication information can include a type of print particles within the print particle dispense nozzle 560. In another example, the authentication information can include a manufacturer of the print particle dispense nozzle 560.

Figure 6:
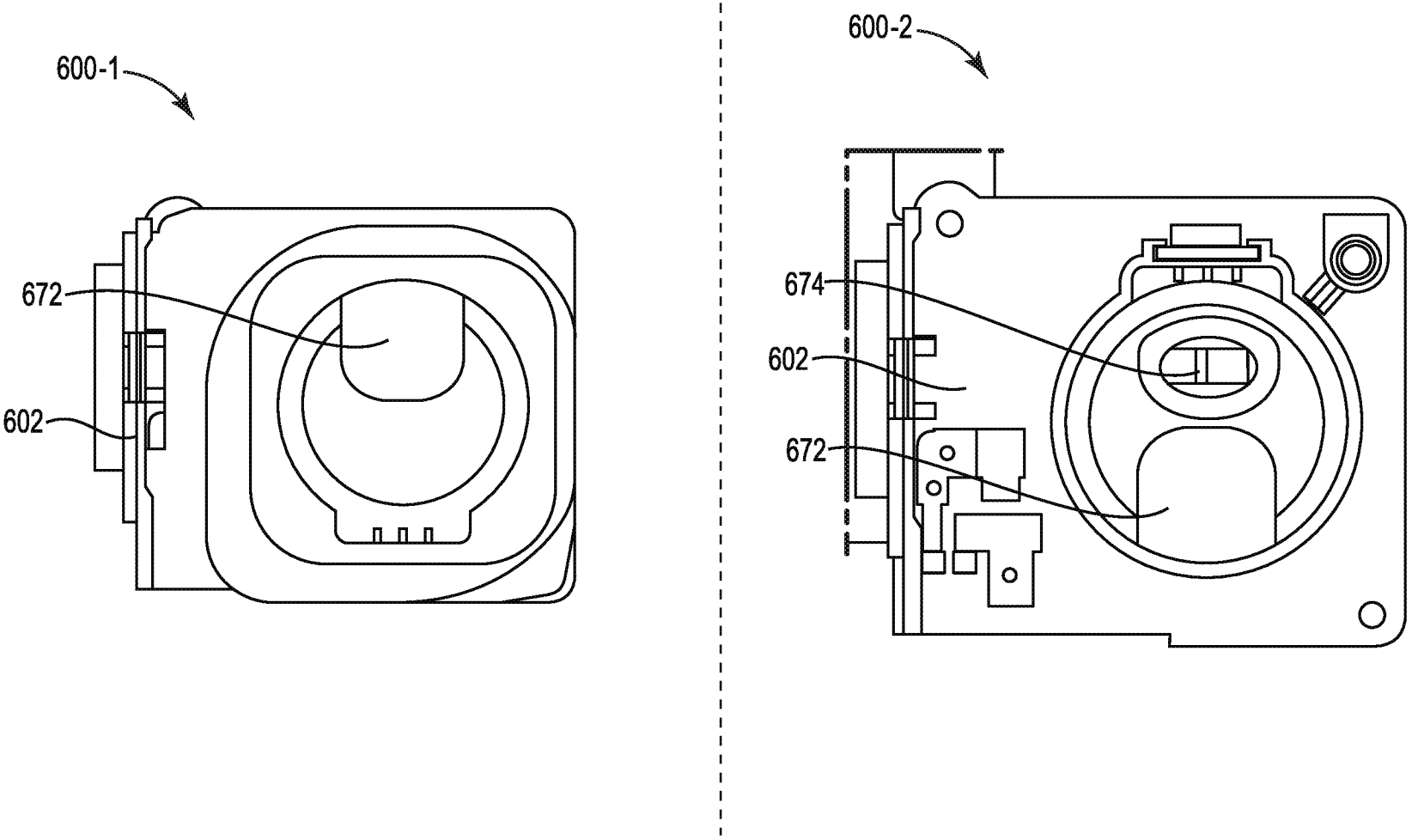
FIG. 6 illustrates a view of an example of a print substance apparatus 400 consistent with the disclosure.

FIG. 6 illustrates a view of an example of a print substance apparatus 600-1, 600-2 consistent with the disclosure. In some examples, the print substance apparatus 600-1, 600-2 can include the same or similar components as the print substance apparatus 100 as illustrated in FIG. 1, the print substance apparatus 200 as referenced in FIG. 2, the print substance apparatus 300 as referenced in FIG. 3, and/or the print substance apparatus 400 as referenced in FIG. 4. In some examples, the print substance apparatus 600-1 can illustrate the when the apparatus is in a closed position and the print substance apparatus 600-2 can illustrate when the apparatus is in an open position.

As described herein, a print substance apparatus 600-1, 600-2 can include a rotatable mating interface 602 that can be rotated between a closed position as illustrated by apparatus 600-1 to an open position as illustrated by apparatus 600-2. In some examples, the print substance apparatus 600-1, 600-2 can include a cover tab 672 that can cover an aperture 674 in the closed position as illustrated by the print substance apparatus 600-1. As described herein, a print particle dispense nozzle can be authenticated and the cover tab 672 can be rotated by the mating interface 602 from a position that covers the aperture 674 to a position that does not cover the aperture 674. In a similar way, the rotatable mating interface 602 can be rotated from the open position to the closed position. Thus, the aperture 674 can be an aperture between the mating interface 602 and the dispense interface. The aperture 674 can be closed when the mating interface 602 is in the first position as illustrated by the print substance apparatus 600-1 and open when the mating interface is in the second position as illustrated by the print substance apparatus 600-2.

The print substance apparatus 600-1, 600-2 can be utilized to authenticate print particle dispense nozzles. As described herein, authenticating the print particle dispense nozzles can prevent unwanted print particle dispense nozzles from dispensing print material particles into the print material particle reservoir of the imaging device. In some examples, an authentication mechanism or circuit assembly can authenticate the print particle dispense nozzle by comparing the print particles of the print particle dispense nozzle to a print particle type to be received by the dispense interface.

For example, the print particle dispense nozzle can include a particular type of print particles from a particular manufacturer. In this example, an authentication mechanism can compare the print particles from the print particle dispense nozzle to the print particles of a print particle reservoir coupled to the dispense interface to determine if the print particles from the print particle dispense nozzle are authorized to be dispensed. In some examples, the print particle type to be received by the dispense interface is a type of print particle stored in a print particle supply coupled to the dispense interface. In these examples, the print particle dispense nozzle can be authenticated and the print substance apparatus 600-1 can be rotated to the print substance apparatus 600-2.

In the foregoing detailed description of the disclosure, reference is made to the accompanying drawings that form a part hereof, and in which is shown by way of illustration how examples of the disclosure may be practiced. These examples are described in sufficient detail to enable those of ordinary skill in the art to practice the examples of this disclosure, and it is to be understood that other examples may be utilized and that process, electrical, and/or structural changes may be made without departing from the scope of the disclosure. Further, as used herein, "a" can refer to one such thing or more than one such thing.

The figures herein follow a numbering convention in which the first digit corresponds to the drawing figure number and the remaining digits identify an element or component in the drawing. For example, reference numeral 102 may refer to element 102 in FIG. 1 and an analogous element may be identified by reference numeral 202 in FIG. 2. Elements shown in the various figures herein can be added, exchanged, and/or eliminated to provide additional examples of the disclosure. In addition, the proportion and the relative scale of the elements provided in the figures are intended to illustrate the examples of the disclosure and should not be taken in a limiting sense.

It can be understood that when an element is referred to as being "on," "connected to", "coupled to", or "coupled with" another element, it can be directly on, connected, or coupled with the other element or intervening elements may be present. In contrast, when an object is "directly coupled to" or "directly coupled with" another element it is understood that are no intervening elements (adhesives, screws, other elements) etc.

The above specification, examples and data provide a description of the method and applications and use of the system and method of the disclosure. Since many examples can be made without departing from the spirit and scope of the system and method of the disclosure, this specification merely sets forth some of the many possible example configurations and implementations.

What is claimed is:

1. An apparatus, comprising:

a mating interface coupled to a dispense interface to interact with a print particle dispense nozzle;

a locking mechanism coupled to the dispense interface to prevent the print particle dispense nozzle from depositing a print particle to the dispense interface; and an authentication mechanism coupled to the locking mechanism to:

authenticate the print particle dispense nozzle; and unlock the locking mechanism when the print particle dispense nozzle is authenticated to allow the print particle dispense nozzle to deposit the print particle to the dispense interface.

2. The apparatus of claim 1, comprising an electrical interface coupled to the mating interface to receive a signal from the print particle dispense nozzle.

3. The apparatus of claim 2, wherein the signal is received by the authentication mechanism to authenticate the print particle dispense nozzle.

4. The apparatus of claim 1, wherein the mating interface is rotatable from a first position to a second position when the locking mechanism is unlocked by the authentication mechanism.

5. The apparatus of claim 4, wherein an aperture between the mating interface and the dispense interface is closed when the mating interface is in the first position and open when the mating interface is in the second position.

6. The apparatus of claim 1, wherein the authentication mechanism authenticates the print particle dispense nozzle by comparing the print particle of the print particle dispense nozzle to a print particle type to be received by the dispense interface.

7. The apparatus of claim 6, wherein the print particle type to be received by the dispense interface is a type of print particle stored in a print particle supply coupled to the dispense interface.

8. A print particle supply, comprising:

a dispense interface coupled to the print particle supply;

a mating interface coupled to the dispense interface to interact with a print particle dispense nozzle, wherein the mating interface is rotatable from a first position to a second position;

a locking mechanism coupled to the dispense interface to control the rotation of the mating interface; and an authentication mechanism coupled to the locking mechanism to:

receive a first signal from the print particle dispense nozzle when the mating interface is in the first position;

authenticate the print particle dispense nozzle based on the first signal;

instruct the locking mechanism to allow the mating interface to rotate from the first position to the second position when the print particle dispense nozzle is authenticated;

receive a second signal from the print particle dispense nozzle when the mating interface is in the second position; and instruct the locking mechanism to allow the mating interface to rotate from the second position to the first position based on the second signal.

9. The print particle supply of claim 8, wherein the first signal includes a manufacturer of the print particle dispense nozzle and a type of print particle within the print particle dispense nozzle.

10. The print particle supply of claim 8, wherein the second signal includes an indication that the print particle dispense nozzle includes a particular quantity of a print particle.

11. A system, comprising:

a mating interface coupled to a dispense interface to interact with a print particle dispense nozzle;

an electrical interface positioned at an interior portion of the mating interface to interact with a corresponding electrical interface of the print particle dispense nozzle when the print particle dispense nozzle is positioned within the mating interface;

a locking mechanism coupled to the dispense interface to interact with a locking tab of the mating interface; and an authentication mechanism coupled to the locking mechanism to:

receive a first signal from the print particle dispense nozzle to authenticate the print particle dispense nozzle;

unlock the locking mechanism to allow the mating interface to rotate from a first position to a second position;

receive a second signal from the print particle dispense nozzle to confirm the print particle dispense nozzle is empty; and unlock the locking mechanism to allow the mating interface to rotate from the second position to the first position.

12. The system of claim 11, wherein the authentication mechanism is to lock the locking mechanism when the mating interface is at the second position.

13. The system of claim 11, wherein the locking tab is positioned at an exterior portion of the mating interface.

14. The system of claim 11, wherein the mating interface includes a first aperture and the dispense interface includes a second aperture.

15. The system of claim 14, wherein the first aperture and the second aperture are aligned when the mating interface is in the second position to allow a print particle to pass through the first aperture and the second aperture.

* * * * *